US009366258B2

(12) United States Patent
Suzuki et al.

(10) Patent No.: US 9,366,258 B2
(45) Date of Patent: Jun. 14, 2016

(54) COMPRESSOR HAVING INTERCOOLER CORE

(75) Inventors: Fumihiro Suzuki, Aichi-ken (JP); Masato Sowa, Aichi-ken (JP); Katsutoshi Shiromaru, Aichi-ken (JP)

(73) Assignee: KABUSHIKI KAISHA TOYOTA JIDOSKOKKI, Aichi-Ken (JP)

( * ) Notice: Subject to any disclaimer, the term of this patent is extended or adjusted under 35 U.S.C. 154(b) by 147 days.

(21) Appl. No.: 13/366,563

(22) Filed: Feb. 6, 2012

(65) Prior Publication Data

US 2012/0201709 A1 Aug. 9, 2012

(30) Foreign Application Priority Data

Feb. 8, 2011 (JP) ..... 2011-024987
Oct. 28, 2011 (JP) ..... 2011-237182
Dec. 14, 2011 (JP) ..... 2011-273700

(51) Int. Cl.

*F04C 29/06* (2006.01)
*F01C 21/10* (2006.01)
*F04C 18/12* (2006.01)
*F04C 29/04* (2006.01)
*F04C 29/12* (2006.01)

(52) U.S. Cl.

CPC ..... *F04C 29/06* (2013.01); *F01C 21/10* (2013.01); *F04C 29/04* (2013.01); *F04C 29/12* (2013.01); *F04C 18/126* (2013.01)

(58) Field of Classification Search

USPC ..... 417/53, 243; 418/83
See application file for complete search history.

(56) References Cited

U.S. PATENT DOCUMENTS 4,061,444 A * 12/1977 Dirk et al. ..... 417/312
4,201,523 A * 5/1980 Olofsson ..... 417/312
4,264,282 A * 4/1981 Crago ..... 417/243
4,347,042 A * 8/1982 Holdsworth ..... 417/53
5,037,278 A * 8/1991 Fujio et al. ..... 418/55.2
6,158,989 A 12/2000 Barito
6,264,443 B1 7/2001 Barito
6,447,264 B1 * 9/2002 Lucas et al. ..... 417/313
6,790,012 B2 * 9/2004 Sharp et al. ..... 417/201
7,563,077 B2 * 7/2009 Santa Ana ..... 417/234
2004/0191100 A1 9/2004 Nakane et al.

(Continued)

FOREIGN PATENT DOCUMENTS

CN 1221076 6/1999
JP 05-57386 7/1993

(Continued)

OTHER PUBLICATIONS

English Machine Translation of JP 2003-184767 A.*

(Continued)

*Primary Examiner* — Jorge Pereiro
*Assistant Examiner* — Paul Thiede
(74) *Attorney, Agent, or Firm* — Greenblum & Bernstein, P.L.C.

(57) ABSTRACT

A compressor has a housing which includes a compression mechanism for compressing and then discharging sucked air, and an intercooler core for cooling the discharged air and mitigating a pressure fluctuation thereof. The housing has a cylinder block integrally formed so as to include a rotor chamber which accommodates the compression mechanism, a silencing and cooling chamber which accommodates the intercooler core, and a discharge hole which provides communication between the rotor chamber and the silencing and cooling chamber.

7 Claims, 13 Drawing Sheets

(56) References Cited

U.S. PATENT DOCUMENTS

| | | | | |
|---|---|---|---|---|
| 2007/0177999 | A1* | 8/2007 | Fujii et al. | 417/410.1 |
| 2007/0217939 | A1 | 9/2007 | Sato et al. | |
| 2015/0023811 | A1* | 1/2015 | Yamada et al. | 417/312 |

FOREIGN PATENT DOCUMENTS

| | | |
|---|---|---|
| JP | 8-21372 | 1/1996 |
| JP | 2002-48062 | 2/2002 |
| JP | 2003-184767 | 7/2003 |
| JP | 2003-285647 | 10/2003 |

OTHER PUBLICATIONS

U.S. Appl. No. 13/339,545 to Masato Sowa et al., which was filed on Dec. 29, 2011.

Japanese Office action, mail date is Oct. 15, 2013.

Chinese Office Action dated Jan. 24, 2014.

* cited by examiner

COMPRESSOR HAVING INTERCOOLER CORE

BACKGROUND OF THE INVENTION

1. Field of the Invention

The present invention relates to compressors.

2. Description of the Related Art

In order to reduce the carbon dioxide emissions, electric vehicles using a fuel cell have been developed. The fuel cell generates electric power by an electrochemical reaction between oxygen supplied to a cathode and hydrogen supplied to an anode. In an electric vehicle, in order to supply oxygen to the cathode of the fuel cell, oxygen in air compressed and supplied by a compressor is used.

However, the compressor has a problem in that various noises are generated from an air inlet side and a discharge outlet side. In addition, in electric vehicles on which a fuel cell is mounted, in view of reaction temperature and heat resistance of the fuel cell, it is necessary to reduce the temperature of the air discharged from the compressor, and a heat exchanger such as an intercooler or the like is provided to reduce the temperature of the discharged air. However, a large number of auxiliaries are mounted in an electric vehicle, and hence there is a problem that it is difficult to secure a mounting space.

Japanese Patent Application Laid-open No. 2003-184767,, for example, describes a screw compressor having two rotors to be mounted on a fuel cell vehicle in which there is provided a silencing and cooling device having a silencing function for reducing noise from the discharge outlet side and a function for cooling discharged fluid (air). In Japanese Patent Application Laid-open No. 2003-184767,, a cover which internally forms an additional space is attached to the outside of the housing of a compressor, and the additional space is formed between two planes which extend orthogonal to a plane connecting the two central axes of the two rotors that are in parallel with each other, and further the two planes pass through the two individual central axes. That is, the additional space is formed at a position where a valley is formed by the pair of rotors in a part of the housing.

Further, the additional space forms an inlet-side space connected to a discharge port of a space where the rotors are accommodated and an exit-side space connected to a discharge outlet serving as an opening of the cover. Furthermore, the inlet-side space and the exit-side space are connected via a plurality of heat exchanging tubes provided in the additional space. Moreover, heat exchanging flow paths are formed in the plurality of heat exchanging tubes, and cooling water paths are formed between the plurality of heat exchanging tubes. In addition, heat exchanging fins attached to the outside of the heat exchanging tubes protrude into the cooling water paths. With this arrangement, when a fluid such as air discharged into the additional space from the discharge port flows from the inlet-side space to the exit-side space, the fluid is subject to a silencing action with its discharge pulsations being damped, and also is subject to a cooling action by effecting heat exchange with the cooling water in the cooling water paths while flowing in the narrowed heat exchanging flow paths formed in the heat exchanging tubes.

However, in the compressor in Japanese Patent Application Laid-open No. 2003-184767,, since the cover is attached to the housing as a separate member, the housing and the cover generate separate vibrations by the mechanical vibration generated by the compressor so that a problem arises that the generated vibration causes the cover to generate a noise, or that the generated vibration may deform the cover and the deformed portion vibrates to generate a noise.

SUMMARY OF THE INVENTION

The present invention has been achieved in order to solve such problem, and an object thereof is to provide a compressor which has a function of cooling a discharged fluid, and is capable of achieving a reduction in noise.

In order to solve the above-described problem, a compressor according to the present invention has a housing which includes a compression mechanism for compressing and then discharging a sucked fluid and a silencing and cooling device for cooling the discharged fluid and mitigating pressure fluctuations thereof, wherein the housing has a cylinder block integrally formed so as to include a compression space which accommodates the compression mechanism, a silencing and cooling space which accommodates the silencing and cooling device, and a communicating hole which provides communication between the compression space and the silencing and cooling space.

DETAILED DESCRIPTION OF THE PREFERRED EMBODIMENTS

A description is given hereinbelow of embodiments of the present invention on the basis of the accompanying drawings.

First Embodiment

First, a description is given of a structure of a compressor 101 according to a first embodiment of the present invention. Note that, in the following embodiments, description is given of an example of a case where a Roots air compressor is used as the compressor which constitutes a part of a fuel cell system mounted on a vehicle and generates discharge pulsations generating a loud sound.

Figure 1:
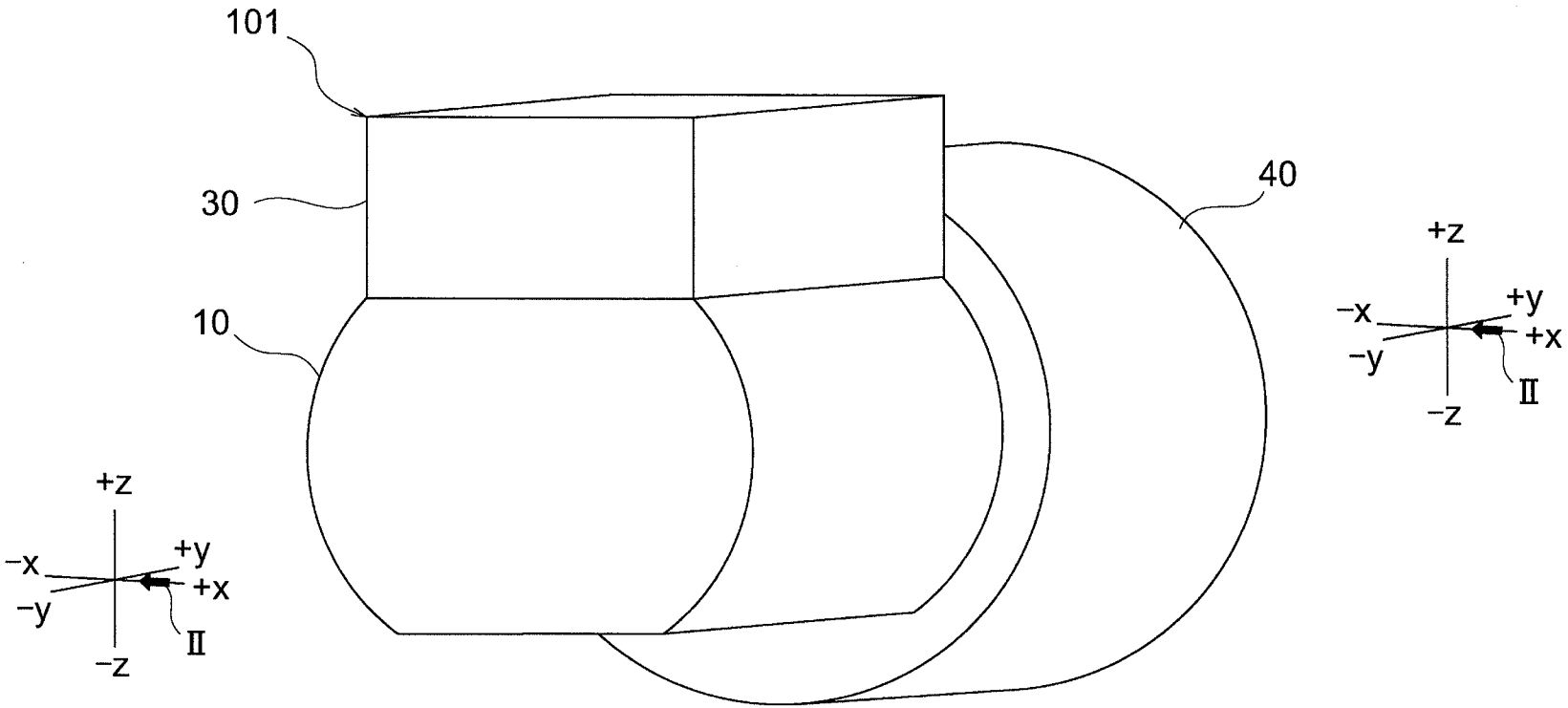
FIG. 1 is a schematic perspective view showing a structure of a compressor according to a first embodiment of the present invention.

Referring to FIG. 1, the compressor 101 integrally includes a compression mechanism portion 10 which internally has a compression mechanism for compressing air as a fluid, and a silencing and cooling portion 30 which internally has a water-cooled intercooler core. In addition, the compressor 101 includes a motor 40 which is integrally coupled to the compression mechanism portion 10 and serves as a drive device for driving the compression mechanism of the compression mechanism portion 10. That is, the compressor 101 is supplied to the market as an assembly of the compressor with the compression mechanism portion 10, the silencing and cooling portion 30, and the motor 40 provided therein.

Herein, it is assumed that a z axis extends from the compression mechanism portion 10 toward the silencing and cooling portion 30, a direction from the compression mechanism portion 10 toward the silencing and cooling portion 30 is a +z direction, and a direction opposite to the +z direction is a −z direction. Further, it is assumed that a y axis extends from the compression mechanism portion 10 toward the motor 40 perpendicularly to the z axis, a direction from the compression mechanism portion 10 toward the motor 40 is a +y direction, and a direction opposite to the +y direction is −y direction. Furthermore, it is assumed that an x axis extends perpendicularly to the y axis and the z axis, a direction from left to right on a paper sheet with the drawing is a +x direction, and a direction opposite to the +x direction is a −x direction.

Figure 2:
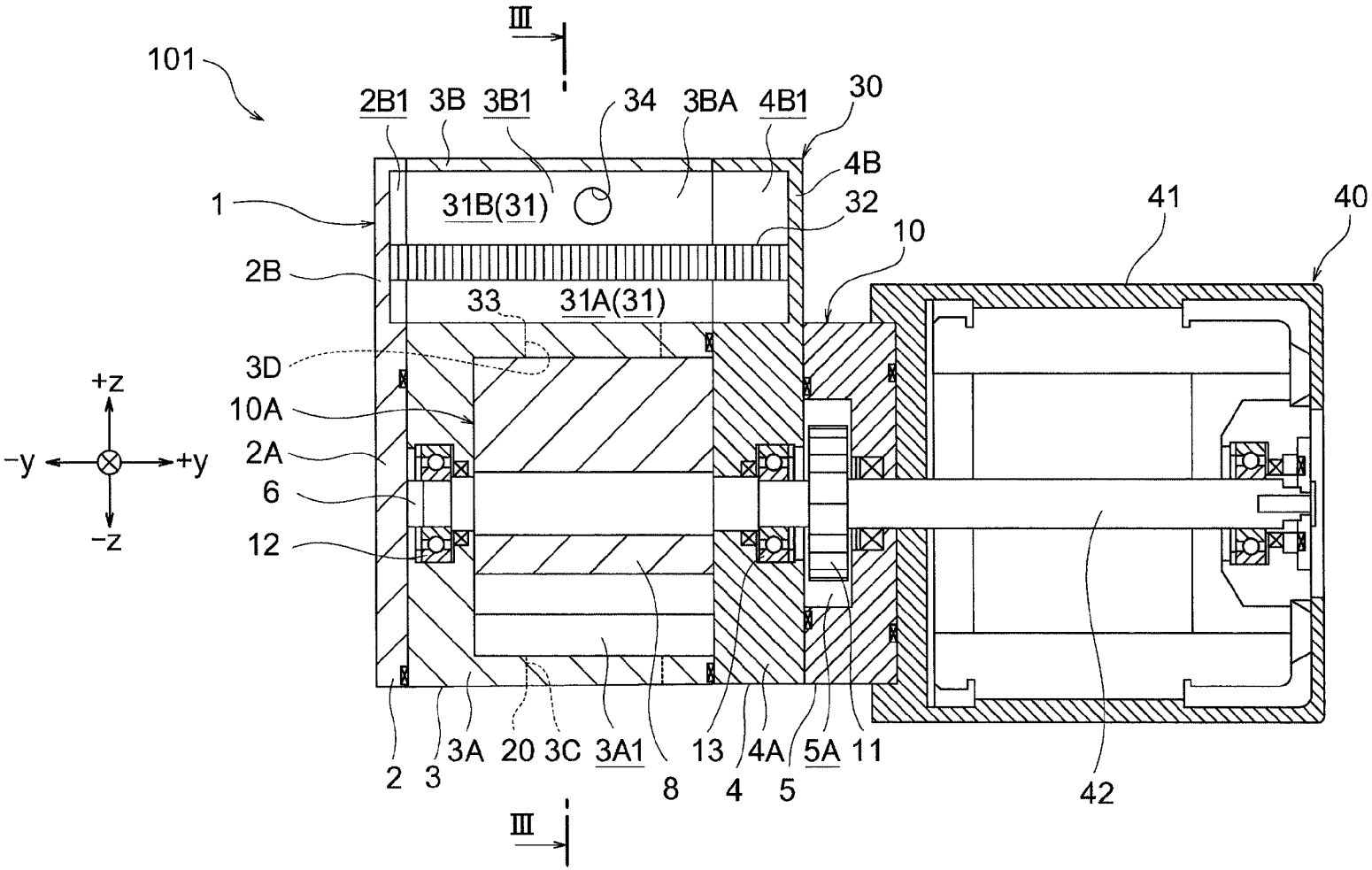
FIG. 2 is a schematic view showing a cross section including a line in the y-y direction and a line in the z-z direction of FIG. 1 as viewed from the direction II.

Referring to FIG. 2, there is shown a cross section of the compressor 101 including a line in the y-y direction and a line in the z-z direction of FIG. 1, i.e., a view of a cross section of the compressor 101 in parallel with a plane including the y axis and the z axis as viewed from the +x direction toward the −x direction, i.e., a view of a cross section of the compressor 101 which passes through the central axis of each of a main rotary shaft 6 of the compression mechanism portion 10 and and a drive shaft 42 of the motor 40.

The compressor 101 has a housing 1 formed integrally with a cylinder block 3 as a central housing, a front housing 2 joined to the cylinder block 3 on a side opposite to the side of the motor 40, a rear housing 4 joined to the cylinder block 3 on the side of the motor 40, and a gear cover 5 joined to the rear housing 4 on the side of the motor 40. In addition, a shell 41 constituting a casing of the motor 40 is integrally coupled to the gear cover 5 on a side opposite to the side of the rear housing 4 and the shell 41 also constitutes a part of the housing 1.

The cylinder block 3 has a structure in which a first cylinder block portion 3A forming the compression mechanism portion 10 and a second cylinder block portion 3B forming the silencing and cooling portion 30 are integrally molded by using the same metal material by casting or the like. The first cylinder block portion 3A internally forms a rotor chamber 3A1 having one side opened in the +y direction, while the second cylinder block portion 3B internally forms a prism-like through portion 3B1 having both sides opened in the +y direction and the −y direction. In this arrangement, the rotor chamber 3A1 constitutes a compression space.

The rear housing 4 has a structure in which a first rear housing portion 4A forming the compression mechanism portion 10 and a second rear housing portion 4B forming the silencing and cooling portion 30 are integrally molded by using the same metal material by casting or the like. The first rear housing portion 4A is joined to the first cylinder block portion 3A so as to cover the opened side of the rotor chamber 3A1. The second rear housing portion 4B forms a prism-like concave portion 4B1 having a side opened in the −y direction and fitting the through portion 381, and is joined to the second cylinder block portion 3B.

The gear cover 5 forms a closed gear chamber 5A on the side of the compression mechanism portion 10 together with the first rear housing portion 4A.

The compression mechanism portion 10 has the main rotary shaft 6 passing through the first cylinder block portion 3A and the first rear housing portion 4A and extending into the gear chamber 5A. The main rotary shaft 6 is coupled to the drive shaft 42 of the motor 40 via a first gear 11 so as to be rotatable integrally with the drive shaft 42. The main rotary shaft 6 is radially supported by a ball bearing 12 provided in the first cylinder block portion 3A and a ball bearing 13 provided in the first rear housing portion 4A.

In addition, the compression mechanism portion 10 has a sub-rotary shaft 7 (see FIG. 3) passing through the first cylinder block portion 3A and the first rear housing portion 4A and extending into the gear chamber 5A. The sub-rotary shaft 7 is coupled to a second gear in the gear chamber 5A (not shown) so as to be rotatable integrally with the second gear, and the second gear is engaged with the first gear 11.

The front housing 2 has a structure in which a first front housing portion 2A forming the compression mechanism portion 10 and a second front housing portion 2B forming the silencing and cooling portion 30 are integrally molded by using the same metal material by casting or the like. The first front housing portion 2A is joined to the first cylinder block portion 3A so as to cover end portions of the main rotary shaft 6 and the sub-rotary shaft 7 (see FIG. 3). The second front housing portion 2B forms a prism-like concave portion 2B1 having a side opened in the +y direction and fitting the through portion 3B1, and is joined to the second cylinder block portion 3B.

Therefore, the concave portion 2B1, the through portion 3B1 and the concave portion 4B1 form a silencing and cooling chamber 31 as one silencing and cooling space in a generally rectangular parallelepiped shape inside the silencing and cooling portion 30.

Further, the compression mechanism portion 10 has a first rotor 8 which is provided inside the rotor chamber 3A1 and coupled to the main rotary shaft 6 so as to be rotatable integrally with the main rotary shaft 6, and a second rotor 9 (see FIG. 3) which is provided inside the rotor chamber 3A1 and coupled to the sub-rotary shaft 7 (see FIG. 3) so as to be rotatable integrally with the sub-rotary shaft 7. In this arrangement, the first and second rotors 8 and 9 constitute rotating bodies.

Figure 3:
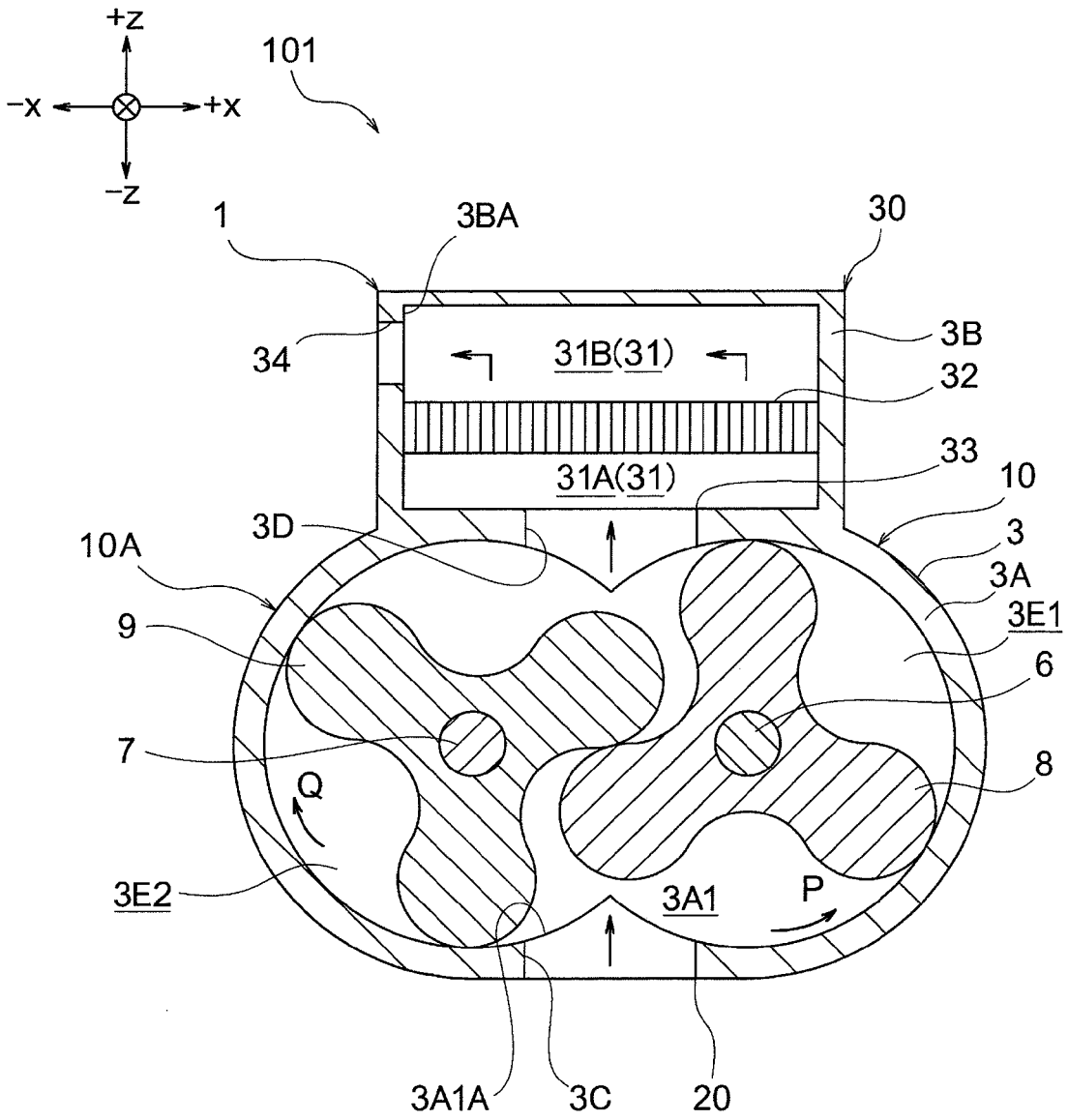
FIG. 3 is a schematic view showing a cross section taken along line III-III of FIG. 2.

Referring to FIG. 3, the first and second rotors 8 and 9 are three-bladed rotors each having three protruding portions, and have the same shape. In addition, the first and second rotors 8 and 9 are engaged with each other such that the protruding portion of one of the rotors fits between the protruding portions of the other rotor.

Further, the first gear 11 (see FIG. 2) and the second gear (not shown) are engaged with each other, and hence, when the main rotary shaft 6 is driven to rotate via the drive shaft 42 (see FIG. 2), the sub-rotary shaft 7 is caused to rotate at the same rotation speed as that of the main rotary shaft 6, and the first and second rotors 8 and 9 thereby rotate in mutually opposite directions at the same rotation speed.

Referring to FIGS. 2 and 3, the first cylinder block portion 3A of the cylinder block 3, the first rear housing portion 4A of the rear housing 4, the gear cover 5, the first rotor 8, the second rotor 9, the main rotary shaft 6, the sub-rotary shaft 7, the first gear 11, the second gear (not shown), and members included inside them constitute the compression mechanism 10A which compresses and then discharges sucked air. Further, the rotor chamber 3A1 accommodates a portion where air is compressed in the compression mechanism 10A.

Referring to FIG. 3, in the cylinder block 3, a discharge hole 3D as a communicating hole which provides communication between the rotor chamber 3A1 and the silencing and cooling chamber 31 is formed between the rotor chamber 3A1 and the through portion 3B1 (see FIG. 2). The discharge hole 3D is opened at an inlet 33 of the silencing and cooling chamber 31. Further, in the first cylinder block portion 3A of the cylinder block 3, a suction hole 3C is formed on a side opposite to the side of the discharge hole 3D relative to the rotor chamber 3A1.

Returning to FIG. 2, in the compression mechanism portion 10, a suction pipe having an air cleaner (not shown) or the like attached thereto is connected to an outer suction opening 20 of the suction hole 3C when the compressor 101 is mounted on a vehicle.

In addition, in the silencing and cooling portion 30, a side portion 3BA (see FIG. 3) of the second cylinder block portion 3B of the cylinder block 3 in the −x direction is formed with a discharge outlet 34 which provides communication between the silencing and cooling chamber 31 and the outside. The discharge outlet 34 is opened to the outside of the silencing and cooling portion 30 in an orientation different from that of the inlet 33, and communicates with a cathode of a fuel cell (not shown) via a pipe.

Further, in the silencing and cooling chamber 31, between the discharge outlet 34 and the discharge hole 3D, there is provided a water-cooled intercooler core 32 formed of cooling pipes in which cooling water flows with fins attached to the cooling pipes. The fins are provided to protrude into fluid flow paths formed between the cooling pipes, and divide the fluid flow paths into lattice-like flow paths. Further, the fins increase heat transfer area between the fluid flowing in the flow paths and the cooling pipes to improve mutual heat exchange efficiency.

The intercooler core 32 extends to divide the silencing and cooling chamber 31 into a first silencing and cooling chamber portion 31A including the inlet 33 and a second silencing and cooling chamber portion 31B including the discharge outlet 34. Consequently, air discharged from the inlet 33 into the first silencing and cooling chamber portion 31A inevitably passes through the intercooler core 32 to flow into the second silencing and cooling chamber portion 31B, and changes its direction to be discharged to the outside from the discharge outlet 34. In this arrangement, the intercooler core 32 constitutes a silencing and cooling device.

Next, a description is given of operations of the compressor 101 according to the first embodiment of the present invention.

Referring to FIG. 2, in the compressor 101, when the motor 40 is started, the motor 40 causes the drive shaft 42 to rotate, the first gear 11 and the main rotary shaft 6 integral with the drive shaft 42 are made to rotate with the rotation of the drive shaft 42 in the compression mechanism portion 10, and the first rotor 8 is made to rotate together with the main rotary shaft 6. With this arrangement, the second gear (not shown) engaged with the first gear 11 is made to rotate, and the sub-rotary shaft 7 (see FIG. 3) and the second rotor 9 (see FIG. 3) are further made to rotate together with the second gear.

Referring to FIG. 3, in this arrangement, the main rotary shaft 6 and the first rotor 8 rotate in a direction P which is a counterclockwise direction in the drawing, while the sub-rotary shaft 7 and the second rotor 9 rotate in a direction Q which is a clockwise direction in the drawing.

With this arrangement, a negative pressure is generated in the vicinity of the suction hole 3C in the rotor chamber 3A1 serving as the suction side, and air as outside air is sucked into the rotor chamber 3A1 from the outside of the compressor 101 via the suction hole 3C and the suction opening 20. The sucked air is contained in a space 3E1 surrounded by the first rotor 8 and an inner peripheral surface 3A1A of the rotor chamber 3A1, and a space 3E2 surrounded by the second rotor 9 and the inner peripheral surface 3A1A of the rotor chamber 3A1. The air contained in the spaces 3E1 and 3E2 is carried along the inner peripheral surface 3A1A of the rotor chamber 3A1 in the directions P and Q, and is discharged to the discharge hole 3D serving as the discharge side in a pressurized state. All of the compressed air discharged to the discharge hole 3D is discharged from the inlet 33 into the first silencing and cooling chamber portion 31A of the silencing and cooling chamber 31 after passing through the discharge hole 3D, further passes through the intercooler core 32 to be discharged into the second silencing and cooling chamber portion 31B, and is discharged to the outside of the compressor 101 from the discharge outlet 34 to be supplied to the cathode of the fuel cell (not shown) as an oxidant.

In this arrangement, since the cooling water flows in the cooling pipes (not shown) in the intercooler core 32, in the silencing and cooling chamber 31, when the compressed air that has its temperature increased by the compression action in the compression mechanism 10A passes through the intercooler core 32, the compressed air is cooled by heat exchange with the cooling water in the cooling pipes.

In addition, the air contained in the spaces 3E1 and 3E2 causes discharge pulsations when the air is discharged to the discharge hole 3D, and the discharge pulsations result in the generation of noise.

However, when the compressed air discharged into the first silencing and cooling chamber portion 31A via the discharge hole 3D passes between the lattice-like fins (not shown) of the intercooler core 32, the compressed air is straightened, pressure fluctuation thereof is mitigated, the discharge pulsations thereof are thereby reduced, and the compressed air is discharged into the second silencing and cooling chamber portion 31B. Therefore, the compressed air discharged to the outside of the compressor 101 from the discharge outlet 34 is in a state where the discharge pulsations thereof are reduced, and the noise generated by the discharge pulsations is reduced. In addition, in the case of the compressed air before passing through the intercooler core 32 as well, an area of a portion where a radiant sound is generated by the discharge pulsation corresponds only to an area of the wall portion of the housing 1 surrounding the first silencing and cooling chamber portion 31A, and is therefore small so that the generated radiant sound is low. Accordingly, in the compressor 101, the noise resulting from the discharge pulsations is reduced by the two actions described above.

As described above, the compressor 101 according to the present invention has the housing 1 which includes the compression mechanism 10A for compressing and then discharging the sucked air and the intercooler core 32 for cooling the discharged air and mitigating the pressure fluctuation thereof. The housing 1 has the cylinder block 3 which is integrally formed so as to include the rotor chamber 3A1 which accommodates the compression mechanism 10A, the silencing and cooling chamber 31 which accommodates the intercooler core 32, and the discharge hole 3D which provides communication between the rotor chamber 3A1 and the silencing and cooling chamber 31.

In this arrangement, in the compressor 101, the intercooler core 32 is capable of cooling the discharged air, and also reducing the noise resulting from the discharge pulsations by mitigating the pressure fluctuations of the discharged air. In addition, in the compressor 101, the intercooler core 32 has both the function of silencing and cooling the air, whereby it is possible to reduce the size of the structure for silencing and cooling the air. Further, in the compressor 101, the silencing and cooling chamber 31 is made to communicate with the discharge side of the rotor chamber 3A1 to be included integrally in the rotor chamber 3A1, whereby the pipe between the silencing and cooling chamber 31 and the rotor chamber 3A1 is obviated making it possible to further reduce the size of the structure therefor. Furthermore, since a pipe is not required between the silencing and cooling chamber 31 and the rotor chamber 3A1, the sound emission area where the radiant sound is generated by the discharge pulsations is reduced so that it is possible to reduce the noise resulting from the radiation of the discharge pulsations.

Moreover, in the compressor 101, since the first cylinder block portion 3A which accommodates the rotor chamber 3A1 and the second cylinder block portion 3B which accommodates the silencing and cooling chamber 31 are integrally formed, the rigidity and strength of their respective coupling portions are improved. With this arrangement, the first cylinder block portion 3A and the second cylinder block portion 3B vibrate integrally from the mechanical vibration of the compression mechanism 10A. As a result, it is possible to prevent the occurrence of problems where the individual portions of the cylinder block 3 independently vibrate to generate noise between them, and the individual portions of the cylinder block 3 independently vibrate to deform the cylinder block 3 and the deformed portion vibrates to generate noise. In addition, the first front housing portion 2A and the first rear housing portion 4A which accommodate the rotor chamber 3A1 and the second front housing portion 2B and the second rear housing portion 4B which accommodate the silencing and cooling chamber 31 are integrally formed, respectively. With this arrangement, it is also possible to prevent a situation in which the housing portions independently vibrate to generate noise between the housing portions, or deform the housing portion and allow the deformed portion to vibrate.

Consequently, the compressor 101 allows a reduction in noise while having the function of cooling the discharged air.

Note that, when the intercooler core 32 is a water cooled type, the intercooler core 32 can reduce the temperature of the discharged air by causing the cooling water flowing in the cooling pipes inside the intercooler core 32 to perform heat exchange with the discharged air passing through the intercooler core 32. In addition, when the intercooler core 32 is an air cooled type, the intercooler core 32 can reduce the temperature of the discharged air by causing gas flowing inside the intercooler core 32 to perform heat exchange with the discharged air passing through the intercooler core 32. Further, the intercooler core 32 improves the heat exchange efficiency of the discharged air by having the fins protrude into the flow paths in which the discharged air flows. As a result, when passing between the fins, the discharged air is straightened and the pressure fluctuations thereof are reduced so that discharge pulsations thereof are reduced. Therefore, since the intercooler core 32 can perform the functions of silencing and cooling the discharged air, the intercooler core 32 allows a reduction in the size of the silencing and cooling chamber 31 by abolishing the use of a silencer or the like.

In addition, in the compressor 101, since the air discharged from the silencing and cooling chamber 31 to the outside is cooled, heat resistance required of the pipe connected to the discharge outlet 34 of the silencing and cooling chamber 31 is reduced. Therefore, it is possible to use a resin pipe instead of a metal pipe as the pipe connected to the discharge outlet 34, whereby it becomes possible to achieve a reduction in the weight of a vehicle on which the compressor 101 is mounted.

Further, the housing 1 of the compressor 101 has the shell 41 which accommodates the motor 40 for driving the compression mechanism 10A. With this arrangement, the compressor 101 is supplied as an assembly of the compressor with the compression mechanism portion 10, the silencing and cooling portion 30 and the motor 40 provided therein. Therefore, it becomes possible to provide a small compressor having the drive device and the functions of silencing and cooling the discharged air.

Furthermore, in the compressor 101, the first front housing portion 2A, the first cylinder block portion 3A and the first rear housing portion 4A, and the second front housing portion 2B, the second cylinder block portion 3B and the second rear housing portion 4B are integrally molded by using metal material, respectively. With this arrangement, each of the front housing 2, the cylinder block 3 and the rear housing 4 is formed of one seamless continuous member. Therefore, it becomes possible to improve the rigidity and strength between the first and second front housing portions 2A and 2B, the first and second cylinder block portions 3A and 3B, and the first and second rear housing portions 4A and 4B.

In the first embodiment, although the silencing and cooling chamber 31 of the silencing and cooling portion 30 is formed of the front housing 2, the cylinder block 3 and the rear housing 4, the silencing and cooling chamber 31 is not limited thereto. The silencing and cooling chamber 31 may also be formed of the cylinder block 3 and the front housing 2, or the cylinder block 3 and the rear housing 4.

Second Embodiment

A compressor 201 according to a second embodiment of the present invention has a single-piece structure in which the front housing 2, the cylinder block 3 and the rear housing 4 of the compressor 101 of the first embodiment are formed of one part. In addition, in the compressor 201, the first cylinder block portion 3A and the second cylinder block portion 3B in the compressor 101 of the first embodiment have substantially identical widths.

Note that, in the following embodiments, the same reference numerals as those in the above drawings indicate the same or similar components so that the detailed description thereof is omitted.

Figure 4:
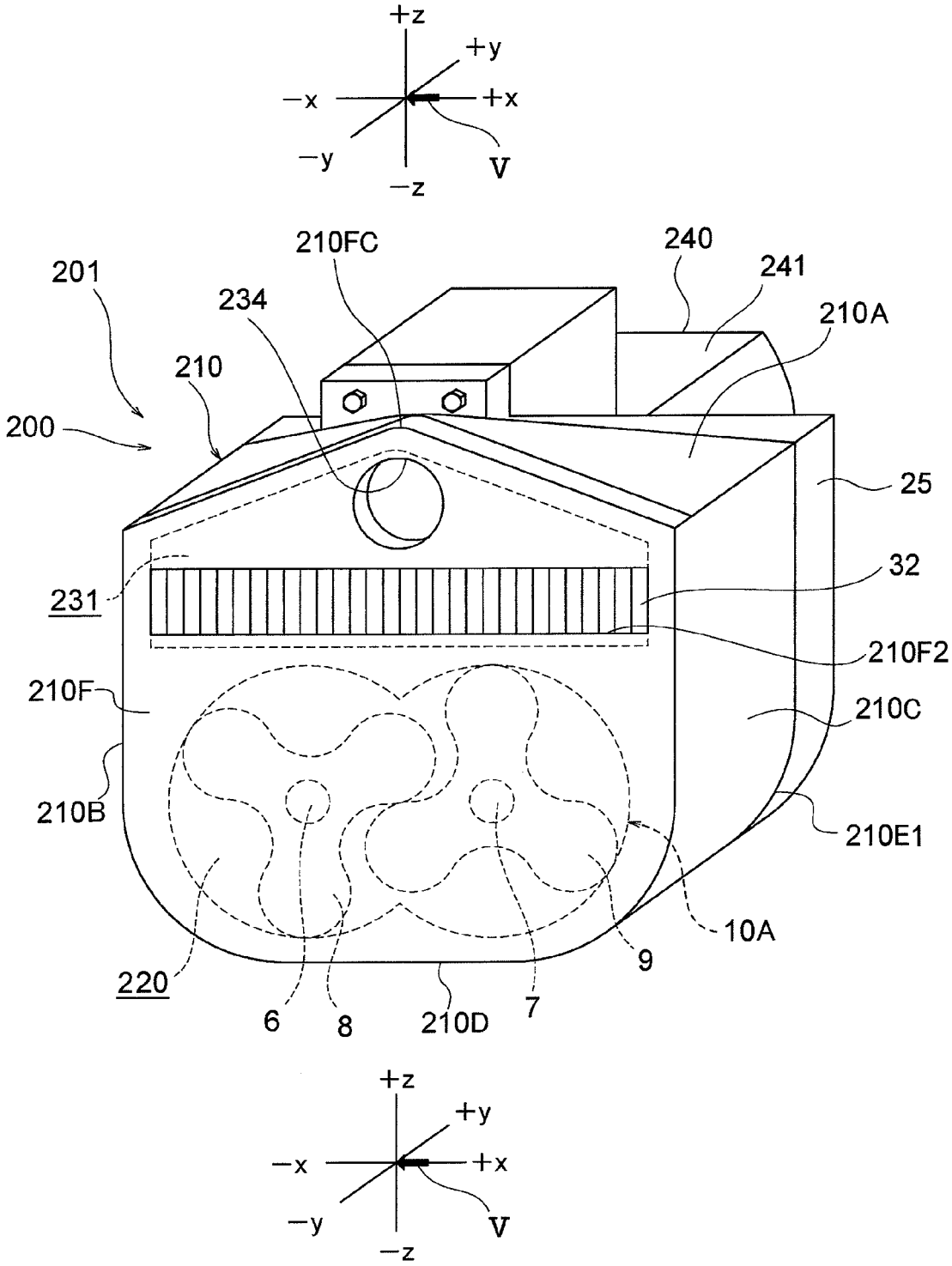
FIG. 4 is a schematic perspective view showing a structure of a compressor according to a second embodiment of the present invention.

Referring to FIG. 4, the compressor 201 has a cylinder block 210 which internally includes a rotor chamber 220 and a silencing and cooling chamber 231, a gear cover 25 coupled to the cylinder block 210, and a shell 241 of a motor 240 coupled to the gear cover 25. The cylinder block 210, the gear cover 25 and the shell 241 constitute a housing 200 of the compressor 201.

The cylinder block 210 is obtained by integrating the front housing 2, the cylinder block 3 and the rear housing 4 in the compressor 101 of the first embodiment. The rotor chamber 220 internally has the main rotary shaft 6, the first rotor 8, the sub-rotary shaft 7 and the second rotor 9. The silencing and cooling chamber 231 is formed on the discharge side of the rotor chamber 220, and internally has the intercooler core 32.

Figure 5:
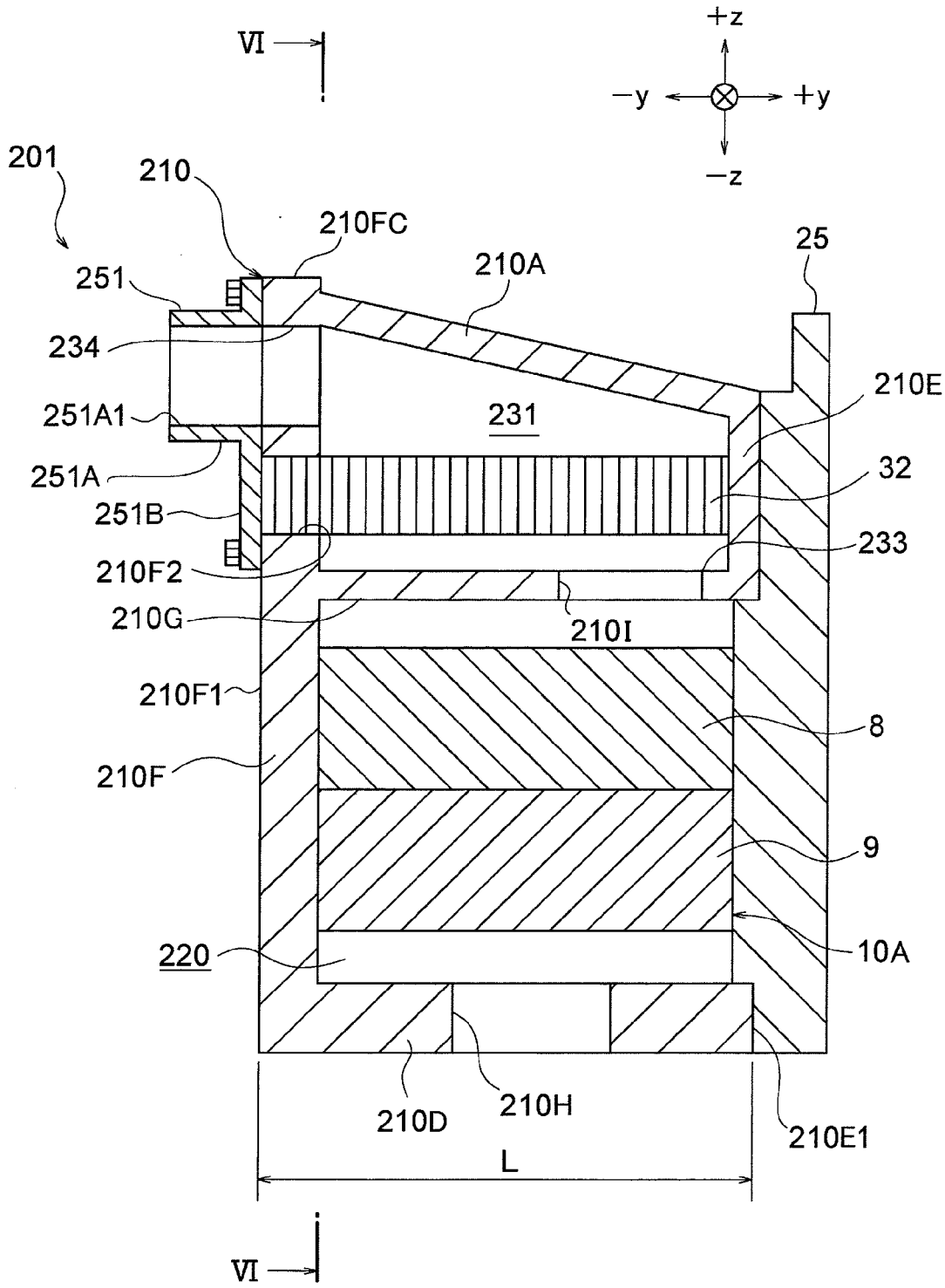
FIG. 5 is a schematic view showing a part of a cross section including a line in the y-y direction and a line in the z-z direction of FIG. 4 as viewed from the direction V.

Referring to FIG. 5 together, which is a view showing a central cross section of the cylinder block 210 and the gear cover 25 including a line in the y-y direction and a line in the z-z direction of FIG. 4 as viewed from the direction V, on a front side opposite to the side of the gear cover 25, the cylinder block 210 integrally has a front wall 210F which corresponds to the front housing 2 in the compressor 101 of the first embodiment. The front wall 210F covers the rotor chamber 220 and the silencing and cooling chamber 231 from the front side. In addition, on the rear side which is the side of the gear cover 25, the cylinder block 210 integrally has a rear wall 210E which corresponds to a part of the rear housing 4 in the compressor 101 of the first embodiment and covers the silencing and cooling chamber 231. Note that, in a rear end portion 210E1 on the rear side in the cylinder block 210, the rotor chamber 220 is opened, and the opening is covered with the gear cover 25. That is, the gear cover 25 constitutes a part of the rear housing 4 in the compressor 101 of the first embodiment.

Further, in the front wall 210F, there is formed a core insertion opening 210F2 for inserting and installing the intercooler core 32 into the silencing and cooling chamber 231 from the outside, and there is further formed a discharge outlet 234 which provides communication between the silencing and cooling chamber 231 and the outside above (+z direction) the core insertion opening 210F2 on a side opposite to the side of the rotor chamber 220.

To an outer surface 210F1 of the front wall 210F, a discharge pipe member 251 is attached. The discharge pipe member 251 has a plate-like flange portion 251B which is fixed to the front wall 210F by using a fastener such as a bolt, and a conduit portion 251A which is provided integrally with the flange portion 251B. When the flange portion 251B is fixed to the front wall 210F, the flange portion 251B covers the core insertion opening 210F2, and a conduit path 251A1 inside the conduit portion 251A fits the discharge outlet 234 to provide communication between the silencing and cooling chamber 231 and the outside. In addition, the conduit portion 251A is connected to a pipe which communicates with the cathode of the fuel cell (not shown). Note that FIG. 4 is depicted with the discharge pipe member 251 being omitted.

The front wall 210F protrudes at a central portion 210FC where the discharge outlet 234 is located upward above both side portions so as to match the shape of the discharge outlet 234.

Further, in the cylinder block 210, there is formed an upper wall 210A which forms the ceiling of the silencing and cooling chamber 231 so as to extend to be inclined downward from the front wall 210F toward side walls 210B and 210C and the rear wall 210E which are formed to be lower than the front wall 210F.

With this arrangement, the height of the cylinder block 210 is reduced, and the area of walls surrounding the silencing and cooling chamber 231 is reduced significantly as compared with a case where the side walls 210B and 210C and the rear wall 210E are formed to have the same height as that of the front wall 210F.

In addition, in the cylinder block 210, in a partition wall 210G which covers the silencing and cooling chamber 231 from the side of the rotor chamber 220 below it and partitions the rotor chamber 220 from the silencing and cooling chamber 231, there is formed a discharge hole 210I forming an inlet 233 of the silencing and cooling chamber 231 on the side of the rear wall 210E. Further, in the cylinder block 210, there is formed a suction hole 210H in a bottom wall 210D (see FIG. 6) which is continuous with the side walls 210B and 210C and is curved.

Therefore, air which goes through the inlet 233 from the rotor chamber 220 and is discharged into the silencing and cooling chamber 231 is discharged from the discharge outlet 234 and the conduit path 251A1 to the outside after passing through the intercooler core 32.

The silencing and cooling chamber 231 is surrounded by the upper wall 210A, the side walls 210B and 210C, the partition wall 210G, the front wall 210F and the rear wall 210E, and is opened at the core insertion opening 210F2, the discharge outlet 234 and the inlet 233. Consequently, the silencing and cooling chamber 231 is made by forming, in the cylinder block 210, a recessed space which has the rear wall 210E as its bottom portion and extends in the horizontal direction from the front wall 210F to the rear wall 210E.

Figure 6:
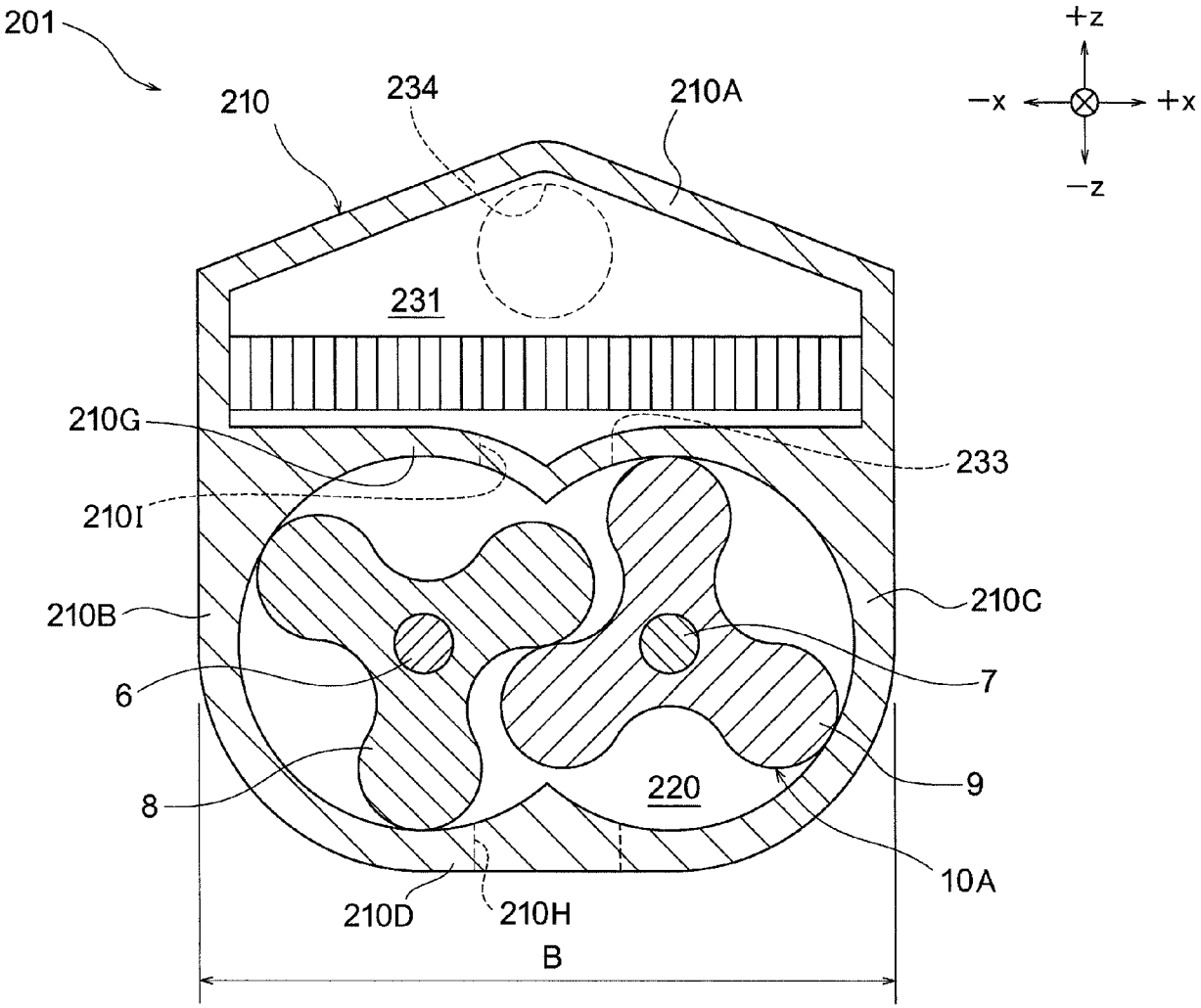
FIG. 6 is a schematic view showing a cross section taken at line VI-VI of FIG. 5.

Referring to FIG. 6, the side walls 210B and 210C of the cylinder block 210 extend in parallel with each other without bend or the like to form the cylinder block 210 having a substantially constant width B from the rotor chamber 220 to the silencing and cooling chamber 231. Further, referring to FIG. 5, the front wall 210F and the rear wall 210E of the cylinder block 210 extend in parallel with each other without bends or the like to form the cylinder block 210 having a substantially constant length L from the rotor chamber 220 to the silencing and cooling chamber 231.

Figure 7:
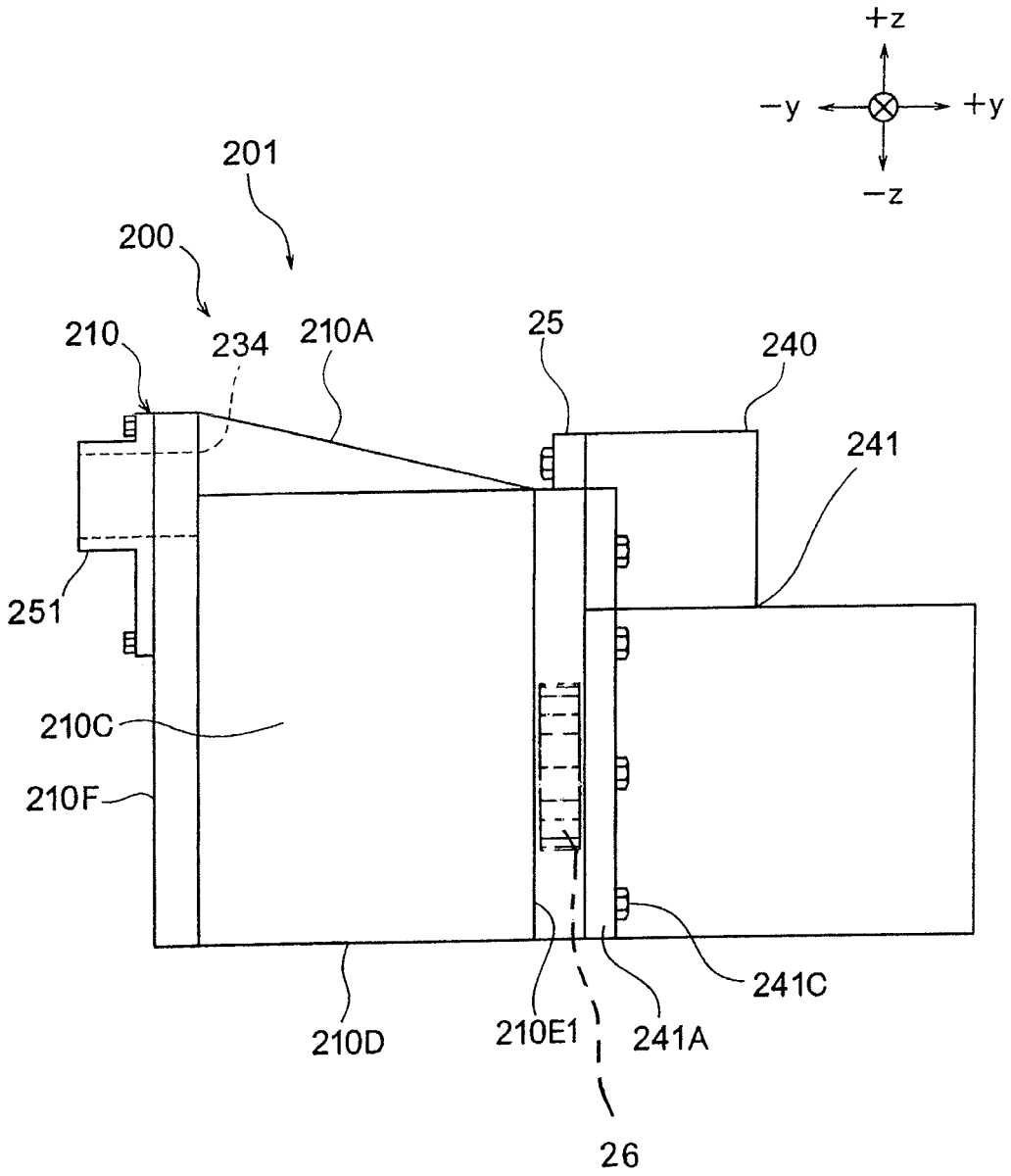
FIG. 7 is a schematic view of the compressor of FIG. 4 as viewed sideways.

Referring to FIG. 7, the shell 241 of the motor 240 internally includes a drive portion and a power source device for supplying electric power to the drive portion, and has a flange 241A at its end portion. In addition, bolts 241C as fasteners extending through the flange 241A and the gear cover 25 are screwed into female screw holes (not shown) of the rear end portion 210E1 of the cylinder block 210, whereby, together with the gear cover 25, the shell 241 is fixed to the cylinder block 210. That is, the shell 241 and the gear cover 25 are integrally fixed to the cylinder block 210 by using the bolts 241C extending therethrough.

The other structures and operations of the compressor 201 according to the second embodiment of the present invention are similar to those of the first embodiment, and hence the descriptions thereof are omitted.

According to the compressor 201 in the second embodiment, effects similar to those of the above-described compressor 101 of the first embodiment can be obtained.

In addition, in the cylinder block 210 of the compressor 201, since the silencing and cooling chamber 231 is formed into the recessed shape having the rear wall 210E as the bottom portion, the silencing and cooling chamber 231 is surrounded by the rigid structure. Therefore, the silencing and cooling chamber 231 is surrounded by walls having a rigidity greater than that of the walls of the silencing and cooling chamber 31 of the first embodiment. With this arrangement, the vibration of the walls surrounding the silencing and cooling chamber 231 relative to the other portions of the cylinder block 210 and the deformation thereof resulting from the discharge pulsation of the compression mechanism 10A are further reduced, and an increase in vibration by resonance is therefore suppressed so that it becomes possible to reduce noise.

Further, in the cylinder block 210 of the compressor 201, the width and the length are substantially constant from the rotor chamber 220 to the silencing and cooling chamber 231. Therefore, the cylinder block 210 does not cause a complicated vibration even when discharge pulsations occur inside the cylinder block 210.

Furthermore, the cylinder block 210 of the compressor 201 has the discharge outlet 234 which provides communication between the silencing and cooling chamber 231 and the outside, and the upper wall 210A as the portion of the cylinder block 210 opposing the discharge hole 210I is formed into the shape inclined from the formation position of the discharge outlet 234 toward the rotor chamber 220. With this arrangement, the height of the cylinder block 210 is reduced so that an acoustic radiation area of the walls surrounding the silencing and cooling chamber 231 is reduced, and the radiant sound is reduced. In addition, the increase in the rigidity of the cylinder block 210 by the reduction in height can reduce its vibration.

Moreover, in the compressor 201, the shell 241 of the motor 240 and the gear cover 25 including a gear mechanism having at least one gear 26 (similar to the first gear 11 of the previous embodiment) for transmitting the driving force of the motor 240 to all of the rotors 8 and 9 are fixed in tandem with each other by using the bolts 241C extending through the cylinder block 210. Since the cylinder block 210, the gear cover 25 and the shell 241 are coupled and fixed together in one line by using the fastener extending therethrough such as the bolt 241C, the rigidity of each coupling portion is increased so that it is possible to reduce the relative vibration between the cylinder block 210 and the shell 241. Note that, even when the bolt 241C extends through the cylinder block 210, a similar effect can be obtained.

In addition, in the compressor 201 of the second embodiment, although the cylinder block 210 has the substantially constant width B and length L, the cylinder block 210 is not limited thereto. At least one of the width and the length of the cylinder block 210 may be reduced from the rotor chamber 220 toward the silencing and cooling chamber 231.

Third Embodiment

In a compressor 301 according to a third embodiment of the present invention, the upper wall 210A of the cylinder block 210 in the compressor 201 of the second embodiment is a member made of a material having damping properties.

Figure 8:
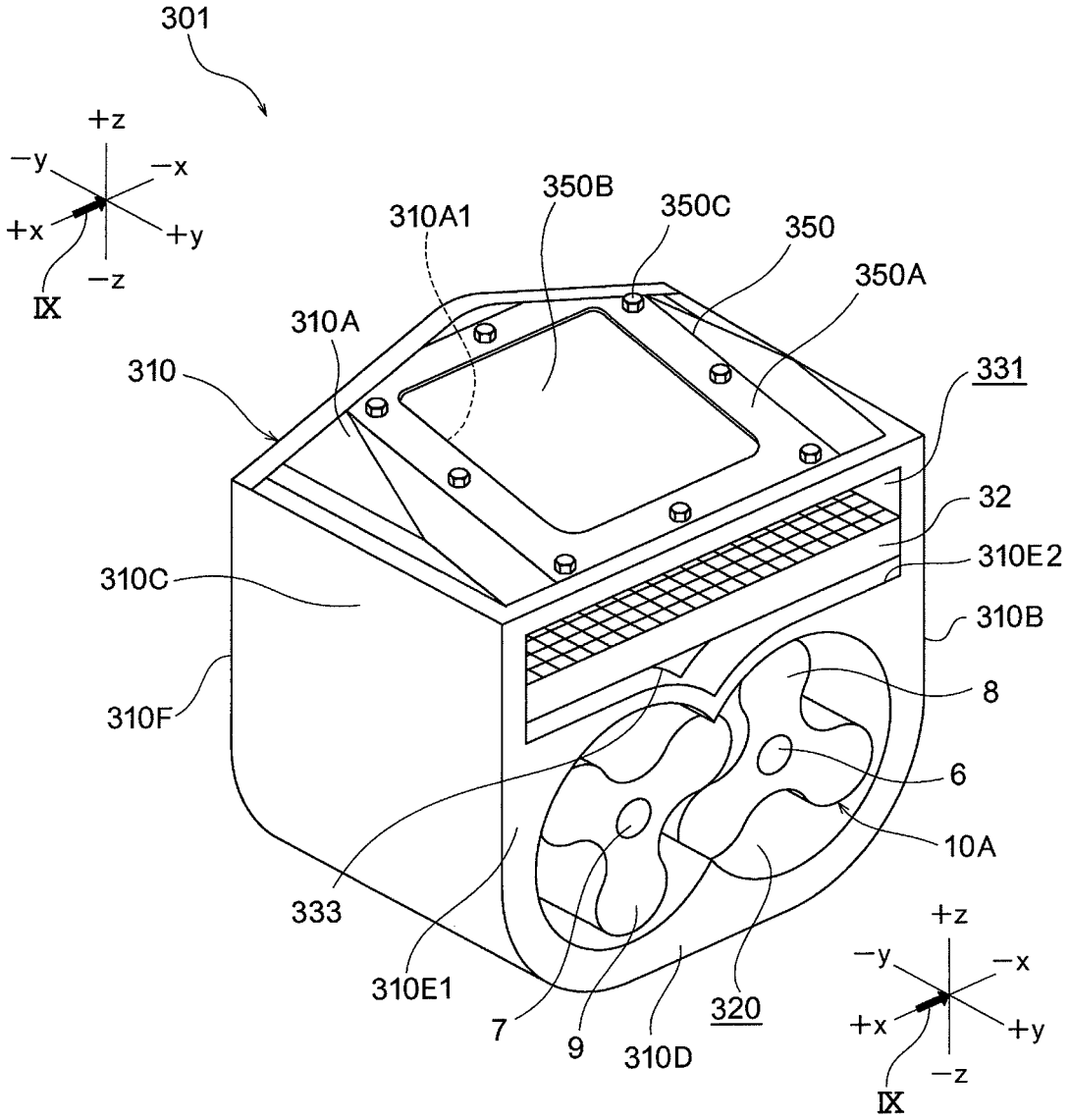
FIG. 8 is a schematic perspective view of a cylinder block of a compressor according to a third embodiment of the present invention as viewed obliquely from behind.
Figure 9:
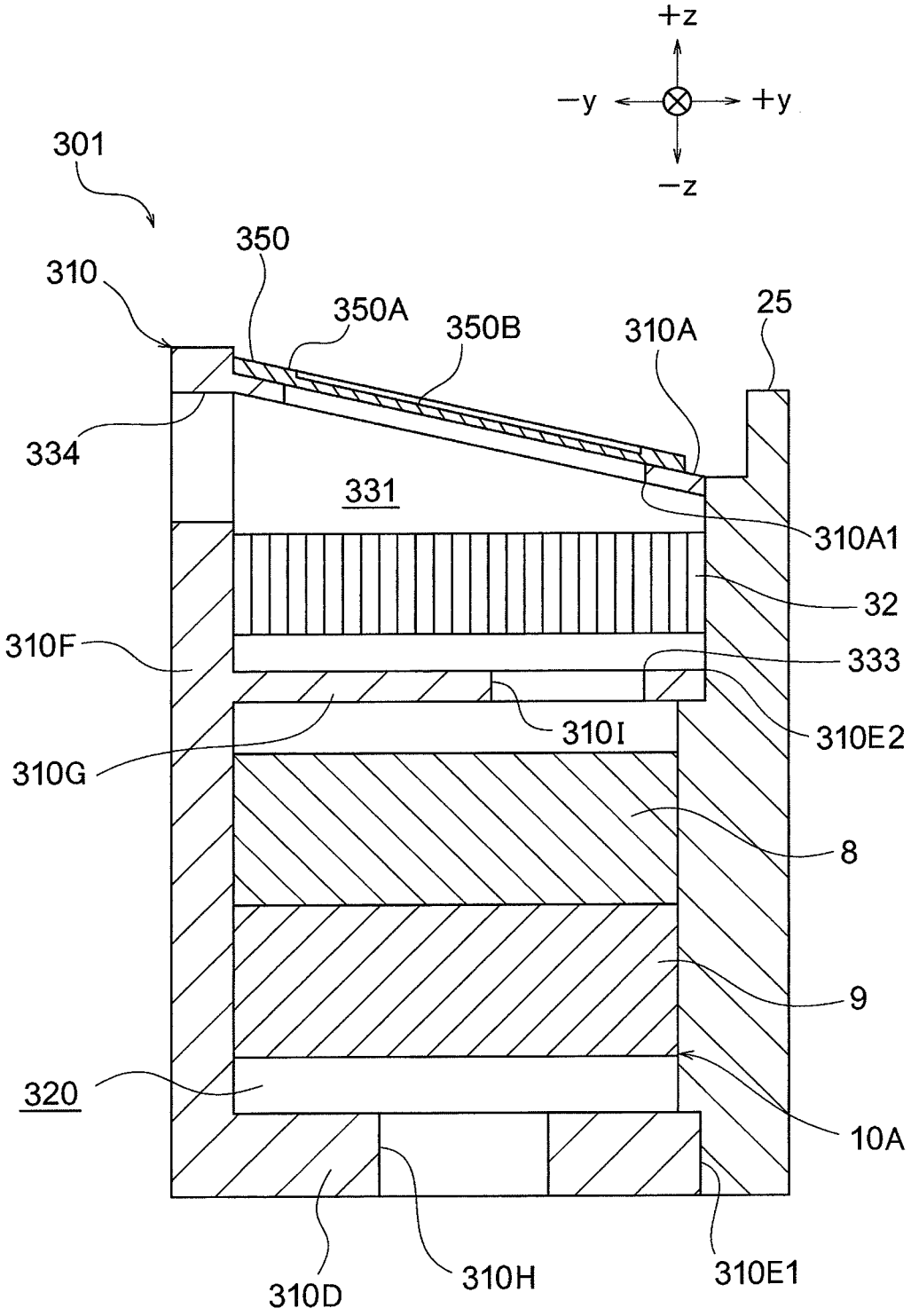
FIG. 9 is a schematic view showing a cross section including a line in the y-y direction and a line in the z-z direction of FIG. 8 as viewed from the direction IX, in which a gear cover is added.

Referring to FIGS. 8 and 9, similarly to the compressor 201 of the second embodiment, a cylinder block 310 of the compressor 301 has an upper wall 310A, side walls 310B and 310C, a bottom wall 310D, a front wall 310F, a rotor chamber 320, a silencing and cooling chamber 331, a suction hole 310H, a discharge hole 310I and a discharge outlet 334. In addition, the cylinder block 310 has a rectangular opening 310A1 which provides communication between the silencing and cooling chamber 331 and the outside in the upper wall 310A. The cylinder block 310 does not have a rear wall in a rear end portion 310E1 but has a cooling chamber opening 310E2 which opens the silencing and cooling chamber 331 on the rear side. The cooling chamber opening 310E2 also serves as the core insertion opening, and the intercooler core 32 is inserted into the silencing and cooling chamber 331 from the cooling chamber opening 310E2 to be installed.

Further, the compressor 301 has a damping cover 350 which covers the opening 310A1 from the outside. The damping cover 350 includes a plate-like edge portion 350A which fits the outer surface of the upper wall 310A at the periphery of the opening 310A1, and a plate-like main body portion 350B which is formed integrally with the edge portion 350A inside the edge portion 350A. In the damping cover 350, the edge portion 350A is fixed to the upper wall 310A by using bolts 350C. In addition, the damping cover 350 is formed such that the main body portion 350B is positioned opposite an inlet 333 (the discharge hole 310I) of the silencing and cooling chamber 331.

Note that the damping cover 350 is made from a material having damping properties. As the material having damping properties, there can be used a constrained type damping material such as a laminated damping steel sheet or a laminated pasted multilayer sheet that has a resin sandwiched between metal sheets, a non-constrained type damping material obtained by pasting, applying or spraying a resin to a metal plate, or a damping alloy in which the metal itself has a vibration absorbing ability. Note that, as the damping alloy, there can be used a composite structure-type alloy such as flake graphite cast iron or the like, a ferromagnetic-type alloy (based on inner friction) such as Silentalloy (Fe—Cr—Al) or the like, a dislocation-type alloy such as magnesium alloy or the like, and a twinning deformation-type alloy such as Mn—Cu alloy or the like. Further, the material having damping properties has a loss factor ($\eta$) of not less than $10^{-2}$. In this arrangement, the damping cover 350 constitutes a wall member made from the damping material in the cylinder block 310.

The other structures and operations of the compressor 301 according to the third embodiment of the present invention are similar to those of the second embodiment, and hence the descriptions thereof are omitted.

According to the compressor 301 in the third embodiment, effects similar to those of the above-described compressor 201 of the second embodiment can be obtained.

In the compressor 301, the cylinder block 310 has the opening 310A1 which provides communication between the silencing and cooling chamber 331 and the outside, and the opening 310A1 is covered with the damping cover 350 made from the damping material. The damping cover 350 attenuates the deformation resulting from the vibration generated by the discharge pulsations of the compression mechanism 10A, and hence the damping cover 350 allows suppression of the vibration of the cylinder block 310 and a reduction in the noise of the compressor 301. In addition, by using the damping cover 350, the noise is not increased even when the rigidity of the wall of the cylinder block 310 is reduced so that the damping cover 350 allows a reduction in the weight of the compressor 301.

In the compressor 301 of the third embodiment, although the damping cover 350 is provided only on the upper wall 310A of the cylinder block 310, the damping cover 350 is not limited thereto. The damping cover 350 may be provided on any of the front wall 310F and the side walls 310B and 310C. In addition, although the damping cover 350 is attached to the cylinder block 310 by using the bolts 350C, the damping cover 350 may also be embedded so as to be integrated with the cylinder block 310 at the time of molding.

Further, the damping cover 350 may be applied to the front housing 2, the cylinder block 3 and the rear housing 4 of the first embodiment, and the upper wall 210A, the side wall 210B, the side wall 210C, the front wall 210F and the rear wall 210E of the cylinder block 210 of the second embodiment.

Fourth Embodiment

In a compressor 401 according to a fourth embodiment of the present invention, the damping cover 350 and its surrounding structure in the compressor 301 of the third embodiment are changed.

Figure 10:
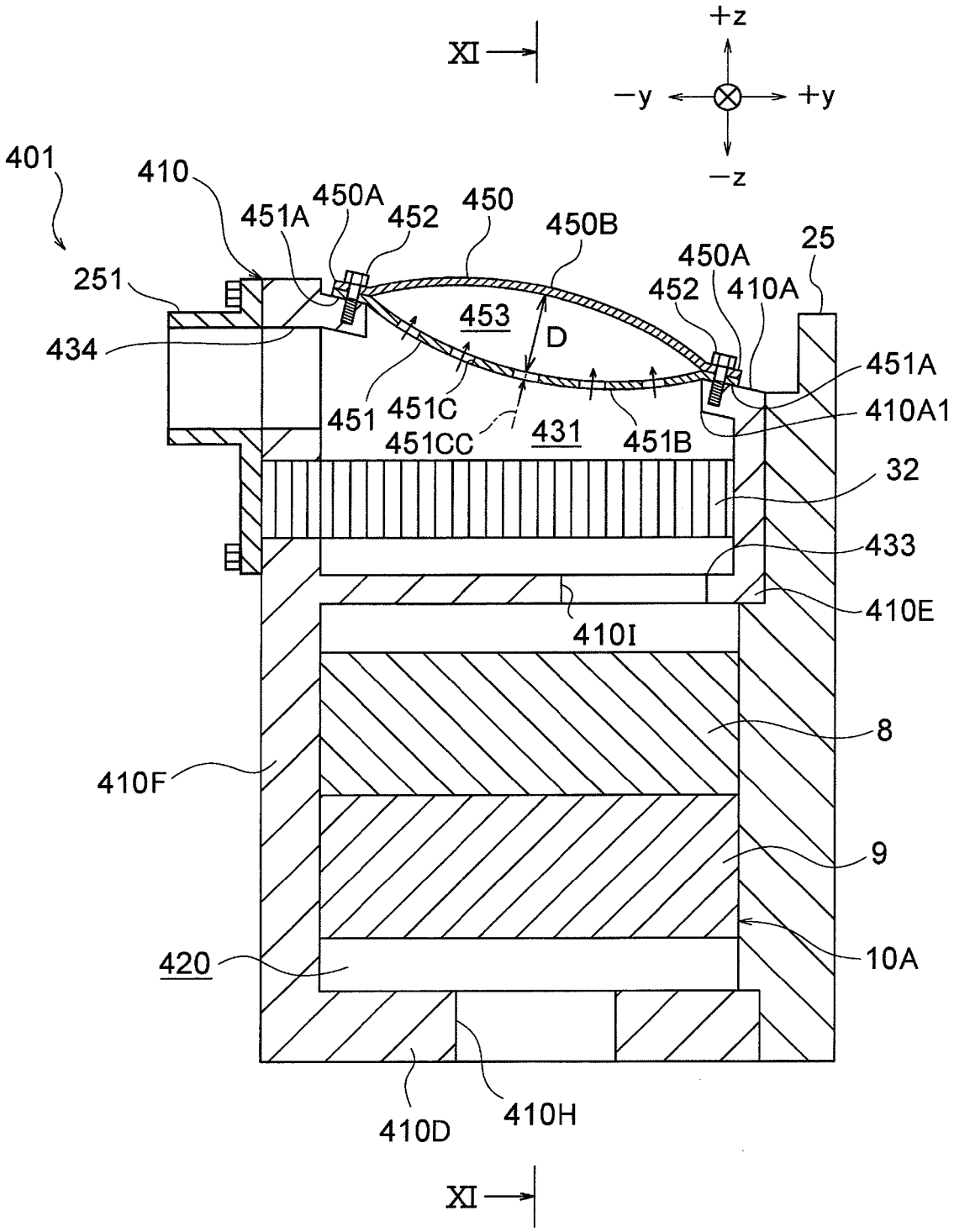
FIG. 10 is a schematic cross sectional side view showing a part of a compressor according to a fourth embodiment of the present invention.
Figure 11:
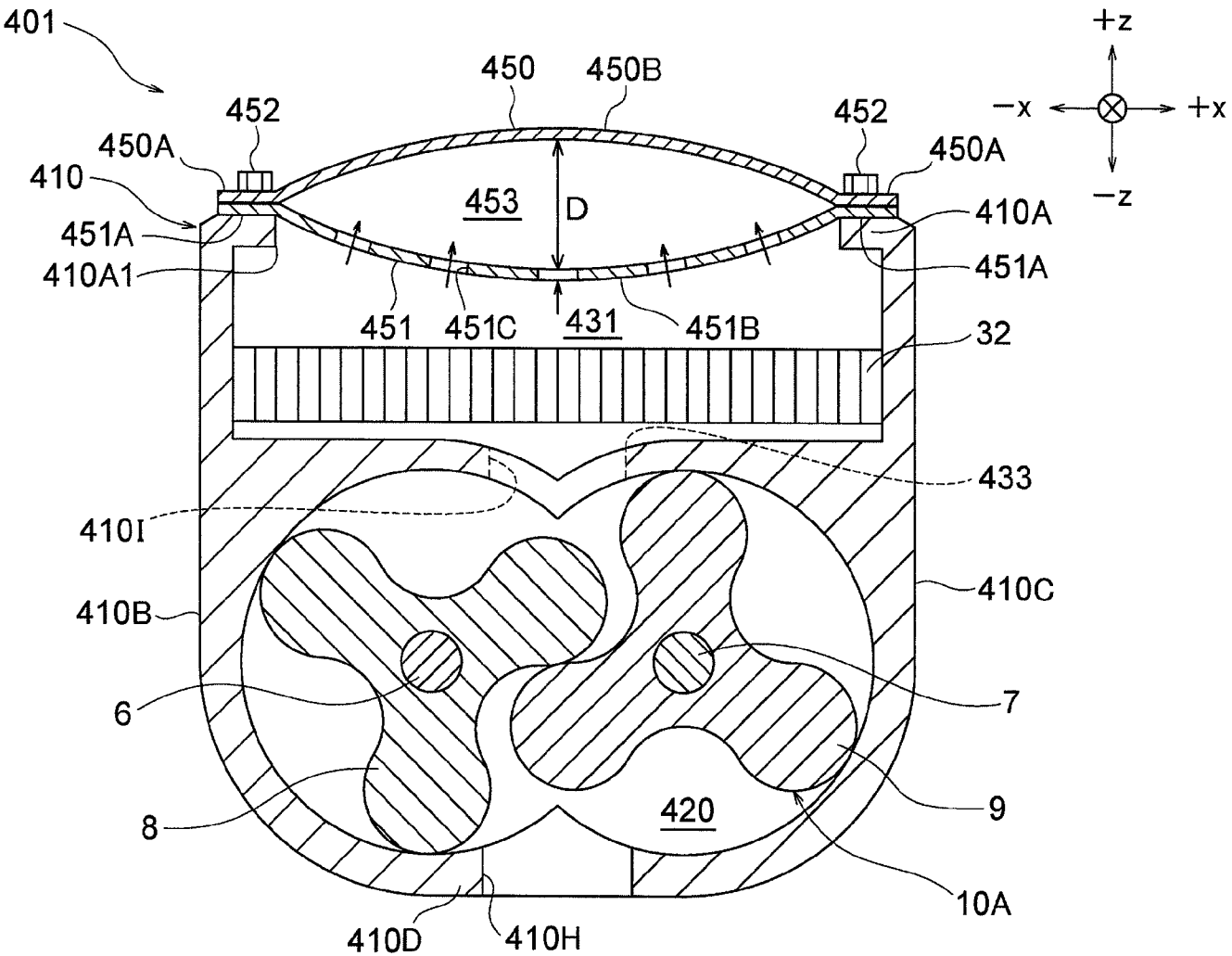
FIG. 11 is a schematic view showing a cross section taken along line XI-XI of FIG. 10.

Referring to FIGS. 10 and 11, as a cylinder block 410 of the compressor 401, there is used a cylinder block similar in structure to the cylinder block 210 of the compressor 201 of the second embodiment. The cylinder block 410 has an upper wall 410A, side walls 410B and 410C, a bottom wall 410D, a front wall 410F, a rear wall 410E, a rotor chamber 420, a silencing and cooling chamber 431, a suction hole 410H, a discharge hole 410I and a discharge outlet 434. In addition, the cylinder block 410 has a rectangular opening 410A1 which provides communication between the silencing and cooling chamber 431 and the outside in the upper wall 410A.

Further, the compressor 401 has a damping cover 450 which covers the opening 410A1 from the outside. The damping cover 450 is made from a material having damping properties similar to that of the damping cover 350 of the third embodiment. The damping cover 450 includes a plate-like edge portion 450A which fits the outer surface of the upper wall 410A at the periphery of the opening 410A1, and a plate-like main body portion 450B which is formed integrally with the edge portion 450A inside the edge portion 450A. The main body portion 450B is curved so as to protrude from the inside of the silencing and cooling chamber 431 toward the outside of the cylinder block 410, and has a smooth convex shape. That is, the main body portion 450B is curved in a direction from the front wall 410F toward the rear wall 410E and also in a direction from the side wall 410B toward the side wall 410C, and has an egg shell-like shell shape.

Furthermore, the compressor 401 has a partition plate 451 between the upper wall 410A and the damping cover 450. The partition plate 451 includes a plate-like edge portion 451A which fits the outer surface of the upper wall 410A at the periphery of the opening 410A1, and a plate-like main body portion 451B which is formed integrally with the edge portion 451A inside the edge portion 451A. The main body portion 451B is curved in the direction from the front wall 410F toward the rear wall 410E and also in the direction from the side wall 410B toward the side wall 410C so as to protrude from the outside of the cylinder block 410 toward the inside of the silencing and cooling chamber 431. The main body portion 451B has the egg shell-like shell shape. Moreover, the partition plate 451 is formed with a plurality of through holes 451C which extend through the main body portion 451B.

The damping cover 450 and the partition plate 451 are fixed to the upper wall 410A by using bolts 452 together with their respective edge portions 450A and 451A. With this arrangement, the partition plate 451 partitions a part of the silencing and cooling chamber 431, and a hollow 453 surrounded by the damping cover 450 and the partition plate 451 is formed at position opposing an inlet 433 (the discharge hole 410I) of the silencing and cooling chamber 431.

In the hollow 453, a thickness D in a direction from the silencing and cooling chamber 431 toward the hollow 453 along a central axis 451CC of the through hole 451C becomes smaller from the center toward end portions so that the thicknesses D at the individual through holes 451C are not identical.

Consequently, air having the pulsations discharged from the inlet 433 into the silencing and cooling chamber 431 passes through the intercooler core 32, then flows toward the partition plate 451, and flows into the hollow 453 through the through holes 451C. With the air flowing into the hollow 453, air inside the hollow 453 acts as a spring, whereby resonance (Helmholtz resonance) occurs inside the hollow 453, frictional loss at each through hole 451C is increased, and the pulsation of the air is reduced. In addition, the thickness D of the hollow 453 differs depending on the position of the through hole 451C, and the frequency of the reduced pulsation thereby differs. With this arrangement, in the hollow 453, the pulsation of the air is reduced in a wide frequency range.

Further, since the main body portion 450B of the damping cover 450 has the shell shape, the rigidity thereof is high as compared with that of the flat plate-like damping cover 350 of the third embodiment. With this arrangement, the damping cover 450 is capable of suppressing the vibration of the damping cover 450 by its high rigidity, and also suppressing the radiation of the vibration via the damping cover 450 by having material characteristics with damping properties.

Consequently, the pulsations of the air discharged into the silencing and cooling chamber 431 are reduced in the intercooler core 32 and then further reduced in the hollow 453 in the wide frequency range, and the radiation of the vibration to the outside, i.e., the radiation of sound is suppressed by the damping cover 450 having high rigidity and damping properties.

The other structures and operations of the compressor 401 according to the fourth embodiment of the present invention are similar to those of the third embodiment, and hence the descriptions thereof are omitted.

According to the compressor 401 in the fourth embodiment, effects similar to those of the above-described compressor 301 of the third embodiment can be obtained. In addition, since the hollow 453, which communicates with the silencing and cooling chamber 431 via the plurality of through holes 451C and has the varied thicknesses, is provided adjacent to the inner side of the damping cover 450, the vibration propagated to the damping cover 450 is reduced in the wide frequency range, the damping cover 450 in the shape having high rigidity reduces the vibration of the damping cover 450, and the radiation of sound resulting from the vibration is thereby reduced. Therefore, the compressor 401 is capable of reducing more noise than the compressor 301 of the third embodiment.

In the compressor 401 of the fourth embodiment, although the damping cover 450 and the partition plate 451 are only provided on the upper wall 410A of the cylinder block 410, the damping cover 450 and the partition plate 451 are not limited thereto, and they may be provided on any of the front wall 410F and the side walls 410B and 410C. In addition, although the damping cover 450 and the partition plate 451 are attached to the cylinder block 410 by using the bolts 452, they may also be embedded so as to be integrated with the cylinder block 410 at the time of molding.

Further, in the compressor 401 of the fourth embodiment, although the damping cover 450 and the partition plate 451 each having the shell shape are provided, the partition plate 451 may have a flat plate-like shape, and the damping cover 450 and/or the partition plate 451 may have a semi-cylindrical shape curved only in one direction. In this case as well, there is formed the hollow 453 having the dimensions D which are not identical at the individual through holes 451C.

Figure 12:
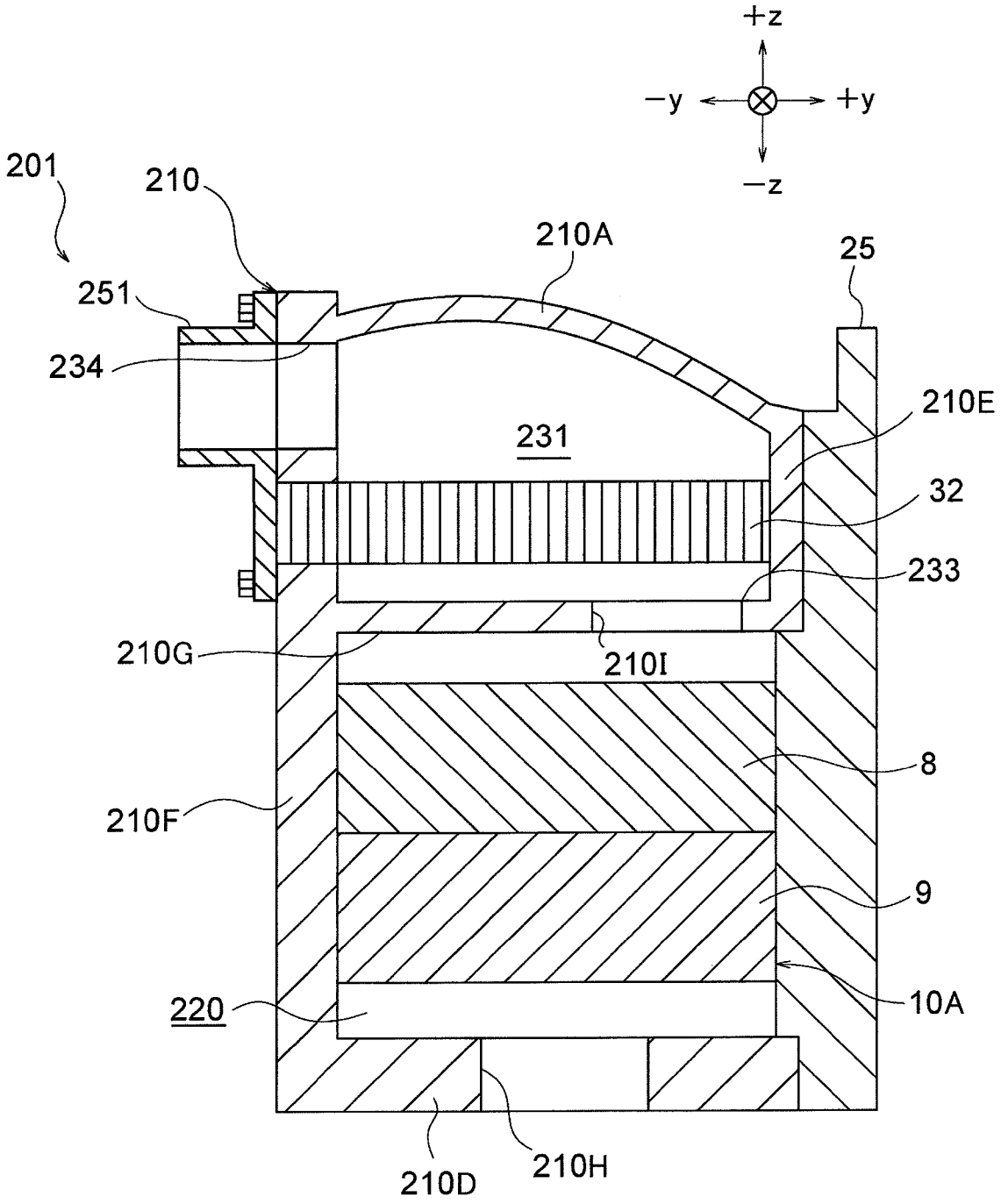
FIG. 12 is a schematic cross sectional side view showing a variation of the compressor according to the second embodiment of the present invention.

Furthermore, in the compressor 401 of the fourth embodiment, although the damping cover 450 is provided on the upper wall 410A of the cylinder block 410 as a separate member, the upper wall 410A itself may be formed into the shell shape. In this case as well, there is formed the hollow 453 having the thicknesses D which are not identical at the individual through holes 451C, and the rigidity of the upper wall 410A is further improved so that the radiant sound is reduced. In each of the front housing 2, the cylinder block 3 and the rear housing 4 of the first embodiment, and the cylinder block 210 of the second embodiment, the wall thereof may be formed into the shell shape. For example, in the case of the cylinder block 210 of the second embodiment, as shown in FIG. 12, the upper wall 210*a*, can be formed into the shell shape. In this arrangement, the rigidity of the upper wall is improved so that the radiation of sound from this wall is reduced.

Moreover, either or both of the damping cover 450 and the partition plate 451 may be applied to the front housing 2, the cylinder block 3 and the rear housing 4 of the first embodiment, and the upper wall 210A, the side wall 210B, the side wall 210C, the front wall 210F and the rear wall 210E of the cylinder block 210 of the second embodiment. In the third embodiment, instead of the flat plate-like damping cover 350, the damping cover 450 may be used. The partition plate 451 may be provided in combination with the flat plate-like damping cover 350 of the third embodiment.

Figure 13:
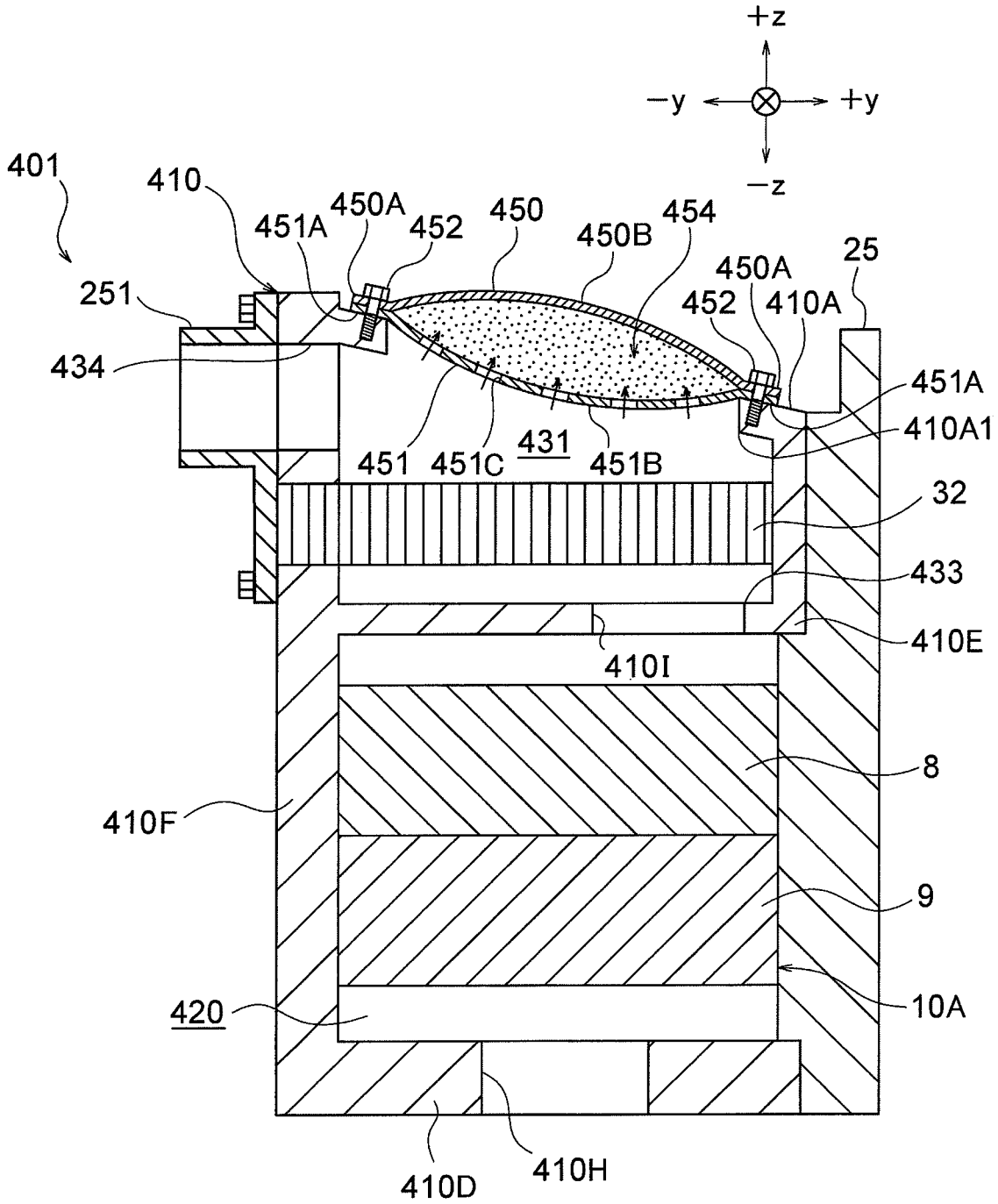
FIG. 13 is a schematic cross sectional side view showing a variation of the compressor according to the fourth embodiment of the present invention.

Further, as shown in FIG. 13, a sound absorbing material 454 may be put into the whole or a part of the hollow 453 in the compressor 401 of the fourth embodiment. The sound absorbing material 454 may be a material which attenuates the pulsations, or a material having elasticity which generates another resonance in the hollow 453 to further reduce the pulsations in another frequency, and it is possible to thereby further reduce the pulsations in the hollow 453. As the sound absorbing material 454, there can be used, e.g., a porous element, an elastic element, or a foam element or the like.

In each of the compressors 101 to 401 of the first to fourth embodiments, although the water-cooled intercooler core 32 is provided in each of the silencing and cooling chambers 31, 231, 331 and 431, the intercooler core 32 is not limited thereto, and an air-cooled intercooler core may be provided.

In the compressors 101 to 401 of the first to fourth embodiments, the discharge outlets 34, 234, 334 and 434 are formed in the side portion 3BA, the front wall 210F, the front wall 310F and the front wall 410F of the cylinder blocks 3, 210, 310 and 410, respectively. Consequently, when each of the compressors 101 to 401 is mounted on a vehicle such that each of the silencing and cooling chambers 31, 231, 331 and 431 is positioned on the upper side of the compressor, each of the discharge outlets 34, 234, 334 and 434 is laterally directed so that it becomes easy to mount each of the compressors 101 to 401 with each of the discharge outlets 34, 234, 334 and 434 directed in a direction other than a direction toward a passenger of the vehicle.

In each of the compressors 101 to 401 of the first to fourth embodiments, although the gear cover 5 or 25 is provided between the rear housing 4 and the shell 41 of the motor 40, or between the cylinder block 210, 310 or 410 and the shell 241 of the motor 240, the gear cover is not limited thereto. The gear cover 5 or 25 may be attached to the front housing 2 or the cylinder block 210, 310 or 410 on a side opposite to the side of the motor 40 or 240.

In each of the first to fourth embodiments, although each of the compressors 101 to 401 is a Roots air compressor, the compressor is not limited thereto, and there can be used a compressor which generates discharge pulsations such as a screw compressor, a centrifugal compressor or the like.

In each of the first to fourth embodiments, although each of the compressors 101 to 401 is used to compress and send a fluid to the fuel cell of the fuel cell vehicle, the compressor is not limited thereto, and can also be applied to a compression mechanism of a supercharger.

What is claimed is:

1. A compressor comprising:

a housing including a cylinder block having a first cylinder block portion and a second cylinder block portion;

a compression mechanism including a plurality of rotating bodies for compressing and discharging a fluid; and a silencing and cooling device including a fluid-cooled intercooler core for cooling the discharged fluid and mitigating a pressure fluctuation thereof, wherein the first cylinder block portion defines a compression space which accommodates the compression mechanism, the second cylinder block portion defines a silencing and cooling space which accommodates the silencing and cooling device, a communicating hole which provides communication between the compression space and the silencing and cooling space is defined in a partition wall between the first cylinder block portion and the second cylinder block portion, and the housing has a partition plate that is provided between the partition wall and a wall portion surrounding the silencing and cooling space, is spaced from the partition wall, defines a hollow between the partition plate and the wall portion, and includes a hole that allows communication between the silencing and cooling space and the hollow.

2. The compressor according to claim 1, wherein the hole defined by the partition plate is a plurality of holes, and a thickness of the hollow in a direction from the silencing and cooling space toward the hollow along a central axis of each of the plurality of holes of the partition plate differs depending on a position of each hole of the plurality of holes defined by the partition plate.

3. A compressor comprising:

a housing including a cylinder block having a first cylinder block portion and a second cylinder block portion;

a compression mechanism including a plurality of rotating bodies for compressing and discharging a fluid; and a silencing and cooling device including a fluid-cooled intercooler core for cooling the discharged fluid and mitigating a pressure fluctuation thereof, wherein the first cylinder block portion defines a compression space which accommodates the compression mechanism, the second cylinder block portion defines a silencing and cooling space which accommodates the silencing and cooling device, the second cylinder block portion including a discharge outlet which provides communication between the silencing and cooling space and an environment outside of the compressor and allows the fluid in the silencing and cooling space to be discharged to the environment outside, a communicating hole which provides communication between the compression space and the silencing and cooling space is defined between the first cylinder block portion and the second cylinder block portion, the intercooler core extends to divide the silencing and cooling space into a first silencing and cooling space portion including the communicating hole and a second silencing and cooling space portion including the discharge outlet, the second cylinder block includes a first partition wall defining the first silencing and cooling space portion, the communicating hole being defined in the first partition wall, and a second partition wall defining the second silencing and cooling space portion, a wall portion of the second partition wall opposing the communicating hole across the silencing and cooling space is sloped from the discharge outlet toward the compression space, and the wall portion of the second partition wall is positioned at an acute angle relative to the first partition wall in a cross-sectional side view of the compressor.

4. A compressor comprising:

a housing including a cylinder block having a first cylinder block portion and a second cylinder block portion;

a compression mechanism including a plurality of rotating bodies for compressing and discharging a fluid; and a silencing and cooling device including a fluid-cooled intercooler core for cooling the discharged fluid and mitigating a pressure fluctuation thereof, wherein the first cylinder block portion defines a compression space which accommodates the compression mechanism, the second cylinder block portion defines a silencing and cooling space which accommodates the silencing and cooling device, a communicating hole which provides communication between the compression space and the silencing and cooling space is defined in a partition wall between the first cylinder block portion and the second cylinder block portion, the housing defines an opening extending through an outer wall of the second cylinder block portion, the opening being covered with a wall member made from a damping material that suppresses noise from the compressor, the second cylinder block portion includes a discharge outlet which provides communication between the silencing and cooling space and an environment outside of the compressor and allows the fluid in the silencing and cooling space to be discharged to the environment outside, the outer wall extends across the silencing and cooling space and is angled relative to the partition wall from the discharge outlet toward the compression space, and the outer wall is positioned at an acute angle relative to the partition wall in a cross-sectional side view of the compressor.

5. A compressor comprising:

a housing including a cylinder block having a first cylinder block portion and a second cylinder block portion;

a compression mechanism including a plurality of rotating bodies for compressing and discharging a fluid; and a silencing and cooling device including a fluid-cooled intercooler core for cooling the discharged fluid and mitigating a pressure fluctuation thereof, wherein the first cylinder block portion defines a compression space which accommodates the compression mechanism, the second cylinder block portion defines a silencing and cooling space which accommodates the silencing and cooling device, the second cylinder block portion including a discharge outlet which provides communication between the silencing and cooling space and an environment outside of the compressor and allows the fluid in the silencing and cooling space to be discharged to the environment outside, a communicating hole which provides communication between the compression space and the silencing and cooling space is defined between the first cylinder block portion and the second cylinder block portion, the intercooler core extends to divide the silencing and cooling space into a first silencing and cooling space portion including the communicating hole and a second silencing and cooling space portion including the discharge outlet, the second cylinder block includes a first partition wall defining the first silencing and cooling space portion, the communicating hole being defined in the first partition wall, and a second partition wall defining the second silencing and cooling space portion, a wall portion of the second partition wall opposing the communicating hole across the silencing and cooling space is sloped from the discharge outlet toward the compression space, and a height of the silencing and cooling space between the first partition wall at the communicating hole and the wall portion of the second partition wall is shorter than a height of the silencing and cooling space between the first partition wall and the wall portion of the second partition wall at the discharge outlet.

6. A compressor comprising:

a housing including a cylinder block having a first cylinder block portion and a second cylinder block portion;

a compression mechanism including a plurality of rotating bodies for compressing and discharging a fluid; and a silencing and cooling device including a fluid-cooled intercooler core for cooling the discharged fluid and mitigating a pressure fluctuation thereof, wherein the first cylinder block portion defines a compression space which accommodates the compression mechanism, the second cylinder block portion defines a silencing and cooling space which accommodates the silencing and cooling device, a communicating hole which provides communication between the compression space and the silencing and cooling space is defined in a partition wall between the first cylinder block portion and the second cylinder block portion, the housing defines an opening extending through an outer wall of the second cylinder block portion, the opening being covered with a wall member made from a damping material that suppresses noise from the compressor, the second cylinder block portion includes a discharge outlet which provides communication between the silencing and cooling space and an environment outside of the compressor and allows the fluid in the silencing and cooling space to be discharged to the environment outside, the outer wall extends across the silencing and cooling space and is angled relative to the partition wall from the discharge outlet toward the compression space, and a height of the silencing and cooling space between the partition wall at the communicating hole and the outer wall is shorter than a height of the silencing and cooling space between the partition wall and the outer wall at the discharge outlet.

7. A compressor comprising:

a housing including a cylinder block having a first cylinder block portion and a second cylinder block portion;

a compression mechanism including a plurality of rotating bodies for compressing and discharging a fluid; and a silencing and cooling device including a fluid-cooled intercooler core for cooling the discharged fluid and mitigating a pressure fluctuation thereof, wherein the first cylinder block portion defines a compression space which accommodates the compression mechanism, the second cylinder block portion defines a silencing and cooling space which accommodates the silencing and cooling device, the second cylinder block portion including a discharge outlet which provides communication between the silencing and cooling space and an environment outside of the compressor and allows the fluid in the silencing and cooling space to be discharged to the environment outside, a communicating hole which provides communication between the compression space and the silencing and cooling space is defined between the first cylinder block portion and the second cylinder block portion, the intercooler core extends to divide the silencing and cooling space into a first silencing and cooling space portion including the communicating hole and a second silencing and cooling space portion including the discharge outlet, the second cylinder block includes a first partition wall defining the first silencing and cooling space portion, the communicating hole being defined in the first partition wall, and a second partition wall defining the second silencing and cooling space portion, a wall portion of the second partition wall opposing the communicating hole across the silencing and cooling space is sloped from the discharge outlet toward the compression space, and the wall portion of the second partition wall extends across the silencing and cooling space and the compression mechanism in a cross-sectional side view of the compressor.

* * * * *